US006641129B2

(12) United States Patent
Ogita et al.

(10) Patent No.: US 6,641,129 B2
(45) Date of Patent: Nov. 4, 2003

(54) SHEET POST-PROCESSING DEVICE

(75) Inventors: Toshiki Ogita, Nara (JP); Shigeki Hayashi, Nara (JP); Kiyoshi Tokishige, Kyoto (JP); Jinichi Nagata, Osaka (JP); Toyoaki Nanba, Higashiosaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 69 days.

(21) Appl. No.: 10/080,953

(22) Filed: Feb. 22, 2002

(65) Prior Publication Data

US 2002/0125626 A1 Sep. 12, 2002

(30) Foreign Application Priority Data

Mar. 8, 2001 (JP) ..... 2001-065259

(51) Int. Cl.[7] ..... B65H 39/10

(52) U.S. Cl. ..... 270/58.08; 270/52.18; 399/407

(58) Field of Search ..... 270/58.08, 58.04, 270/58.11, 52.18; 399/407–410

(56) References Cited

U.S. PATENT DOCUMENTS

| | | | | |
|---|---|---|---|---|
| 5,722,031 | A | * | 2/1998 | Fujii et al. |
| 5,857,670 | A | * | 1/1999 | Jung |
| 6,000,894 | A | * | 12/1999 | Suzuki et al. |
| 6,142,469 | A | * | 11/2000 | Nanba et al. |

FOREIGN PATENT DOCUMENTS

| | | |
|---|---|---|
| JP | 64-034868 | 6/1989 |
| JP | 01-209270 | 8/1989 |
| JP | 08-310717 | 11/1996 |
| JP | 10-324445 | 8/1998 |

* cited by examiner

*Primary Examiner*—Christopher P. Ellis
*Assistant Examiner*—Mark A. Deuble
(74) *Attorney, Agent, or Firm*—Renner, Otto, Boisselle & Sklar, LLP

(57) ABSTRACT

Part of the space occupied by a conveying device (guides) for conveying sheets and part of the space occupied upon movement of a post-processing device (stapler) for achieving a post-process over the sheets on the post-processing tray (post-processing sheet stacking table) are adapted to share the same space.

3 Claims, 5 Drawing Sheets

SHEET POST-PROCESSING DEVICE

BACKGROUND OF THE INVENTION (1) Field of the Invention

The present invention relates to a sheet post-processing device for subjecting printed sheets to stapling and the like, for use in an image forming apparatus, and more detailedly, relates to a post-processing device which can contribute to miniaturization of an image forming apparatus.

(2) Description of the Prior Art

Conventionally, there have been image forming apparatus which have a post-processing means such as a stapler etc., for subjecting the sheets to post processes. With concern to the post-processing means, various technologies have been disclosed.

For example, Japanese Patent Application Laid-Open Sho 64 No.34868 and Japanese Patent Application Laid-Open Hei 1 No.209270 disclose sheet post-processing devices in which a post-processing means is arranged under a post-processing tray for holding sheets to be post-processed.

This sheet post-processing device is constructed so that the sheets placed on the post-processing tray are post-processed at their corners by a post-processing means disposed under the post-processing tray and then the thus post-processed sheets are discharged from the post-processing tray. This arrangement makes it unnecessary for the post-processing means to remove when the sheets are discharged. Further, discharge of the sheets after post-processing from the post-processing tray can be realized with a fixed sheet guide means which is provided close to the post-processing tray.

Japanese Patent Application Laid-Open Hei 8 No.310717 and Japanese Patent Application Laid-Open Hei 10 No.324445 disclose sheet post-processing devices capable of effecting post-processes at the center of each side of the sheets, in addition to their corners only.

The sheet post-processing device disclosed in Japanese Patent Application Laid-Open Hei 8 No.310717 is so constructed that the post-processing means can move along the discharged direction of the sheets already discharged, effect the post-process on the side perpendicular to the discharged direction of the sheets already discharged and retracts in the direction perpendicular to the discharged direction of the already discharged sheets so as to allow for pickup of the sheets after the post-processing treatment. Here, since this post-processing device is configured so as to effect its post-processing task over the sheets having been discharged on the discharge tray, the discharge tray functions as the post-processing tray.

In the post-processing device disclosed in Japanese Patent Application Laid-Open Hei 10 No.324445 the post-processing means is arranged on the side of the post-processing tray opposite to the direction in which the sheets after post-processing are discharged, and post-processing is effected on the sheet edge opposing the post-processing means, and the sheets after post-processing are discharged by a pusher.

However, in the sheet post-processing device disclosed in Japanese Patent Application Laid-Open Hei 8 No.310717, the post-processing means is constructed so as to approach, and retract from, the sheets placed on the post-processing tray, in the direction perpendicular to the discharged direction of the sheets. Therefore, when a post-process is implemented at the middle of the first discharged sheet edge, the distance between the position on the sheets at which the post-process is effected and the sheet edge perpendicular to that from which the sheets are discharged becomes large, hence the arm of the post-processing device needs to be long, which proportionally makes the post-processing means greater.

For post-processes such as stapling sheets with a stapler or punching on sheets using a punch, a relatively large drive force is needed. This is all the more so, i.e., a greater drive force becomes needed when the arm of the post-processing device becomes longer. This results in the problem that the post-processing device becomes complicated and large due to the increase in size of the drive source such as a motor, due to the necessity of a multiple reduction gear configuration and the like.

In such a post-processing means, the above problem becomes more distinct if the direction in which the post-processing means advances to and retracts from the sheets corresponds to the length of the sheets.

In the sheet post-processing device disclosed in Japanese Patent Application Laid-Open Hei 8 No.310717, in order to inhibit the increase in size of the post-processing means to as little as possible, the device configuration is devised so as not to enlarge the distance between the position on the sheets at which the post-process is effected and the sheet edge perpendicular to that from which the sheets are discharged, by adopting a long-edge feed scheme if the entry direction of the sheets relative to the post-processing tray and the direction of sheet discharge from the post-processing tray are the same.

However, this configuration poses a new problem that the advantage obtained when the sheets are fed in their short-edge direction, or the reduction in sheet feed time and reduction in job completion time cannot be obtained.

For the sheet post-processing device disclosed in Japanese Patent Application Laid-Open Hei 10 No.324445, it is possible to solve the problems with the sheet post-processing device disclosed in Japanese Patent Application Laid-Open Hei 8 No.310717, explicitly, the bulky configuration of the post-processing means, complexity of the drive mechanism of the post-processing means, the large drive source of the post-processing means and the like.

Nevertheless, since the space used upon the movement of the post-processing means, the space for the input means to carry sheets into the post-processing tray and the space for the discharging means to discharge the sheets from the post-processing tray, need to be secured individually, this inefficiently consumes the space inside the post-processing device, resulting in obstruction against design flexibility and leading to the bulkiness of the machine.

This situation is the same as in the case of the sheet post-processing device disclosed in Japanese Patent Application Laid-Open Hei 8 No.310717.

SUMMARY OF THE INVENTION

The present invention has been proposed under the circumstances described above, and it is therefore and object of the present invention to inhibit an increase in size of the arm portion of a post-processing means, increase in size of the drive source of the post-processing means, complexity of the drive mechanism of the post-processing means and the like even if the post-processing means which is disposed on the side from which the post-processed sheets are discharged to the discharge tray is constructed so as to advance to or retract from the sheets in order to effect a post-process over the sheets or discharge the sheets. It is another object of the present invention to prevent increase in size of the device attributed to the necessity of individually securing within the device, the space used for the movement of the post-processing means, the space for the conveying means to convey sheets into the post-processing tray and the space for the discharging means to discharge the sheets from the post-processing tray.

In order to achieve the above object, the present invention is configured as follows:

In accordance with the first aspect of the present invention, a sheet post-processing device includes:

a post-processing table for stacking sheets;

a post-processing means capable of moving between the post-processing position where a post-process is effected on the sheets stacked on the post-processing table and the retracted position where the post-processing means is retracted from the sheets placed on the post-processing table so that the sheets can be discharged;

a conveying means which conveys sheets into, or discharging sheets from, the post-processing table, and has a part which retracts from the space occupied by the post-processing means when the post-processing means is moved to the post-processing position and which also occupies the same space when the post-processing means is moved to the retracted position; and a shifting means for moving the post-processing means and the conveying means part in such a manner that the conveying means part retracts from the space occupied by the post-processing means when the post-processing means is moved to the post-processing position and moves and also moves into the space occupied by the post-processing means when the post-processing means moves back to the retracted position.

In accordance with the second aspect of the present invention, the sheet post-processing device having the above first feature further includes: a stopper means which moves between a blocking position where discharge of the post-processed sheets on the post-processing table is blocked and the free position where discharge of the post-processed sheets on the post-processing table is permitted, wherein only after the post-processing means has moved to the retracted position and the conveying means part has also moved to the space occupied by the post-processing means, the stopper means moves from the blocking position to the free position.

In accordance with the third aspect of the present invention, the sheet post-processing device having the above first feature is characterized in that the post-processing means rotates about an axis extending in a direction perpendicular to the discharged direction of sheets in the post-processing table so as to be retracted to the side opposite to the sheet stacking face of the post-processing table.

DESCRIPTION OF THE PREFERRED EMBODIMENTS

One embodiment of the a sheet post-processing device according to the present invention will hereinbelow be described with reference to the accompanying drawings.

<Printing Machine Configuration>

Figure 1:
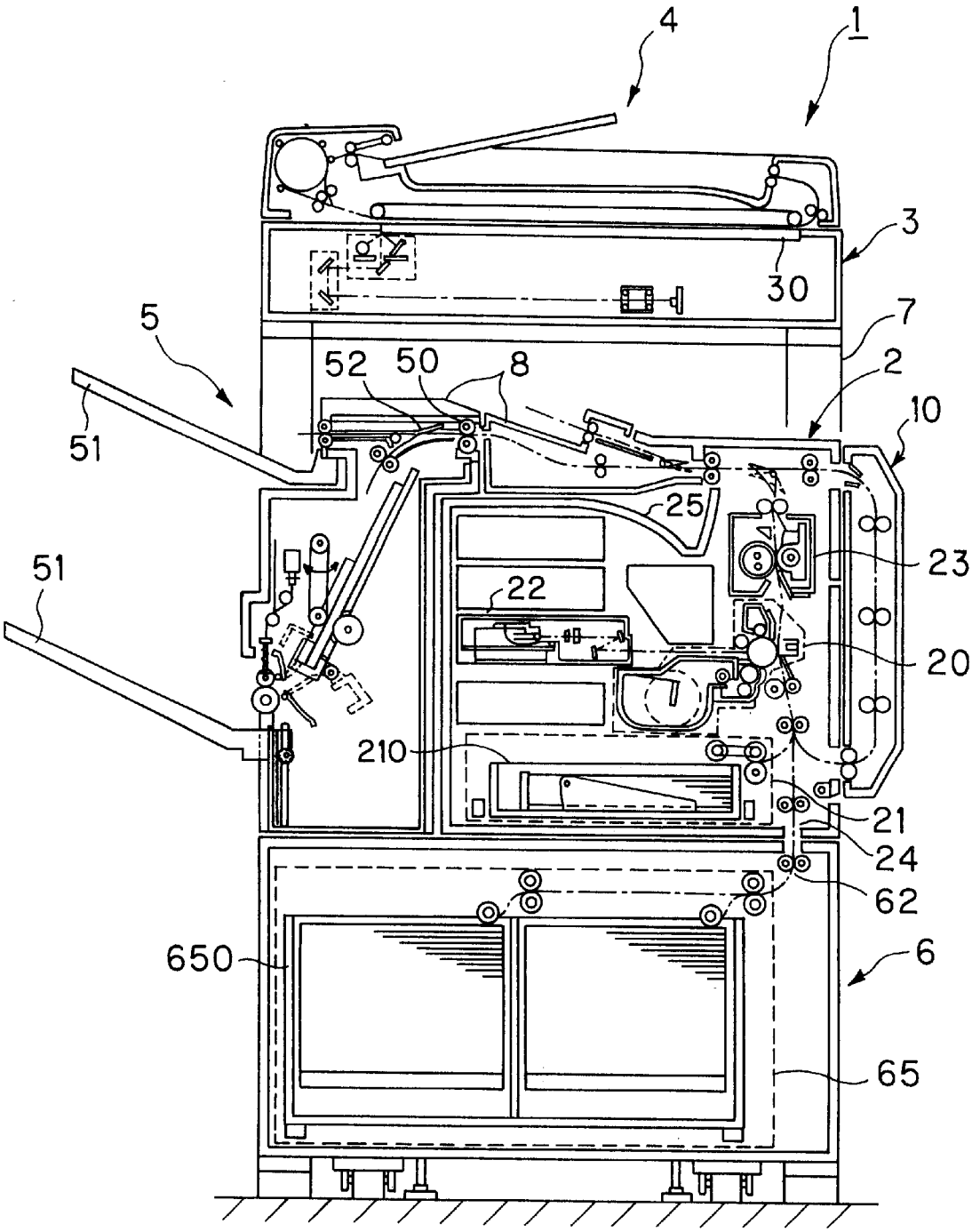
FIG. 1 is a sectional view showing the configurational example of an image forming system to which a sheet post-processing device according to one embodiment of the present invention is applied.

FIG. 1 is a sectional view showing an example of a printing machine configuration as an image forming system to which the sheet post-processing device according to one embodiment of the present invention is applied.

As shown in FIG. 1, this printing machine 1 has a printer 2 and further includes a scanner 3, automatic document feeder 4, sheet post-processing device 5, multi-layered paper feed unit 6 and duplex conveyer unit 10, all connected to printer 2 to extend the function of the printer. Scanner 3 as well as automatic document feeder 4 arranged thereabove is supported on a scanner support table 7 and is laid out over printer 2 and sheet post-processing device 5.

(Printer>

Printer 2 not only outputs records of the images scanned by scanner 3 but also outputs records of image data from an image processing apparatus such as personal computers and the like if they are externally connected to the printer.

Arranged at the right side in the middle of printing machine 1 is an electrophotographic processing unit 20 mainly comprised of a photoconductor drum.

Briefly describing, this electrophotographic processing unit 20 includes a charging roller for uniformly charging the photoconductor drum surface, an optical scanning unit 22 for scanning a light beam over the uniformly charged, photoconductor drum surface so as to write a static latent image thereon, a developing unit for making the static latent image written by optical scanning unit 22 visible with the developer, a transfer unit for transferring the image reproduced on the photoconductor drum onto the a sheet of recording material, a cleaning unit for removing the developer left over on the photoconductor drum so as to allow for next image recording on the photoconductor drum, and a charge erasing lamp unit for erasing the charge on the photoconductor drum surface, all being arranged around the photoconductor drum, in the mentioned order.

Printer 2 incorporates a recording sheet feeder 21 at the bottom thereof. Recording sheets are separated and delivered one by one from this recording sheet feeder 21, and successively fed into and between the photoconductor drum and transfer unit in electrophotographic processing unit 20 so that the image recorded and reproduced on the photoconductor drum is transferred to the sheet. The loading of recording sheets to this recording sheet feeder 21 is carried out by pulling out a recording sheet storage tray 210 to the front side of printing machine 1.

Formed on the underside of printer 2 is an expansion recording sheet input port 24 for receiving recording sheets delivered from a multi-layered paper feed unit 6 or the like, which is equipped as a peripheral and successively feeding them toward and between the photoconductor drum and transfer unit in electrophotographic processing unit 20.

A fixing unit 23 is arranged over electrophotographic processing unit 20 and successively receives recording sheets with images transferred thereon and fuses and fixes the developer transferred on the recording sheets and discharges them out of the apparatus. The recording sheets with images recorded thereon are discharged to a discharge portion 25 arranged on the top of printer 2.

In the spaces over and under optical scanning unit 22, a processing control unit (PCU) board for control of the electrophotographic process, an interface board for receiving image data from the outside of the apparatus, an image control unit (ICU) board for subjecting the image data supplied through the interface board to predetermined image processes so as to allow optical scanning unit 22 to implement scanning for recording and a power source unit for supplying power to these boards and units.

<Multi-layered Paper Feeder Unit>

Multi-layered paper feeder unit 6 is an expansion recording sheet feeder which holds stacks of recording sheets and separates recording sheets, one by one, from the stacks of sheets to deliver them toward a recording sheet discharge port 62 arranged at the top of multi-layered paper feeder unit 6. Here, the recording sheet feeder is constructed of a large-capacity paper tray 65 in which a pair of trays are arranged side by side in a single layer for mass-printing.

Loading of recording sheets into the recording sheet feeder is carried out by pulling out a recording sheet storage tray 650 to the front side of multi-layered paper feeder unit 6.

In the above description, the multi-layered paper feeder unit is described referring to a unit having two recording feeders provided in layers, but the multi-layered paper feeder unit may include at least one or more than one recording sheet feeders and recording sheet discharging portions.

<Sheet Post-Processing Device>

Sheet post-processing device 5 receives recording sheets recorded with images and discharged from printer 2 and subjects the recording sheets to post-processes.

The post-processes implemented in sheet post-processing device 5 include stapling, sorting and the like. The sheet post-processing device 5 shown in FIG. 1 includes a pair of paper output trays 51, which each can hold a large quantity of sheets thereon, and can discharge the sheets to these discharge trays 51, switching from one to another, as required.

The details of the processing mechanism of this sheet post-processing device 5 will be described later.

<Scanner>

Scanner 3 has the automatic reading mode in which sheet-like original documents are automatically fed by automatic document feeder 4 so as to read the images of the originals one by one by exposure and scanning, and the manual reading mode in which book-like originals or sheet-like originals which cannot be automatically fed by automatic document feeder 4 are set manually so as to read the images of the originals.

The image of an original set on a transparent original table 30 is exposed to light and scanned so that the light image is focused on the photoelectric transducer, whereby the original image is converted into electric signals to be output.

<Recording Sheet Transport Unit>

Recording sheet transport unit 8 is a feeder unit which is mounted to the discharge portion of printer 2 and introduces the recording sheets which have been recorded with images and discharged from printer 2 toward sheet post-processing device 5 located downstream of printer 2.

This recording sheet transport unit 8 includes in its course of the recording sheet feed path, a recording sheet holding surface for guiding and supporting recording sheets in order to temporarily introduce one recording sheet on the top of recording sheet transport unit 8, and switches back and conveys the recording sheet in the opposite direction toward the recording sheet duplex feeder.

<Duplex Feeder Unit>

Duplex feeder unit 1 receives the switched back recording sheet from printer 2 in order to form another image on the underside of the sheet, opposite to the side already recorded, and includes a return feed path mechanism for returning the recording sheet to the feed path on the upstream side of the image forming portion of printer 2.

<Detailed Configuration and Operation of the Sheet Post-Processing Device>

The configuration and procedures of the operation of the above-mentioned sheet post-processing device 5 will be described with reference to FIGS. 2 and 4. Here, description of a post-process will be made taking an example of stapling a bundle of sheets.

Figure 2:
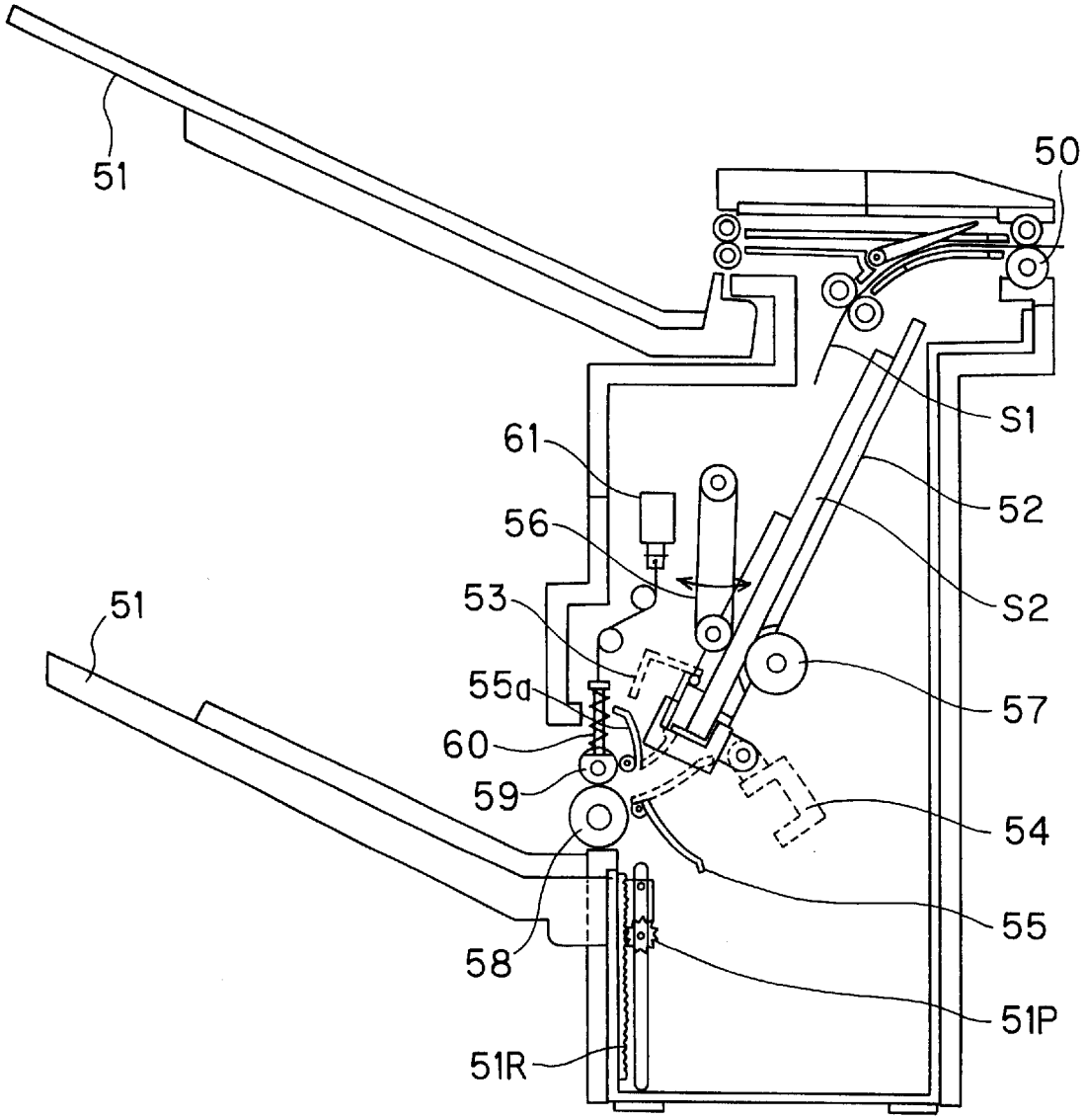
FIG. 2 is a sectional view showing the sheet post-processing device.

FIG. 2 is a detailed sectional view showing the sheet post-processing device 5 shown in FIG. 1.

In FIG. 2 the positions over a sheet bundle S2 of a stopper 53, stapler 54 and a pair of guides 55*a,* 55, after the post-processing are shown by the dashed line.

The sheet post-processing device 5 according to this embodiment is featured by shifts in position of stapler 54 etc. in linkage with completion of the post-process over the sheet bundle S2. Further, these components share the space for the positional movements so as to reduce the space necessary for these components to shift, thus preventing the device from becoming bulky.

A sheet S1 printed by printer 2 is placed on a post-processing sheet stacking table 52 by a feed roller 50. When the leading end of this sheet S1 is temporarily positioned between a movable feed roller 56 and a feed roller 57, the movable feed roller 56 moves in the direction of the arrow in FIG. 2, whereby the sheet S1 drops until it reaches stopper 53. Thus, the post-processing sheet stacking table 52, having the sheet S1 placed thereon, becomes ready for holding a next sheet to be fed.

Sheet bundle S2 after the post-process, is conveyed along guides 55*a,* 55 by gravity and the drives of feed rollers 57 and movable feed roller 56, then passes through and between a movable discharge roller 59 and a discharge roller 58 and is discharged to paper output tray 51.

Here, it should be noted that a solenoid 61 is controlled in accordance with the thickness of sheet bundle S2 so as to cause the movable discharge roller 59 to move up and down via a spring shaft 60. Further, the lower paper output tray 51 is adapted to move up and down by the combination of a rack 51R arranged inside the housing of sheet post-processing device 5 and a pinion 51P fixed to part of paper output tray 51. This arrangement makes it possible for new sheets to be placed thereon even if sheets have been already held on the paper output tray 51.

<Stapler>

After completion of stapling the sheet bundle S2 stapler 54 needs to retract from its position so as not to obstruct the conveyance of sheet bundle S2. In the present embodiment, as indicated by the dashed line in FIG. 2, stapler 54 is fixed at its part to a shaft that extends perpendicular to the feed direction of sheet bundle S2 so that stapler 54 pivots on the shaft and retracts to the side opposite to the stacking side of post-processing sheet stacking table 52. Thus, the stapler 54 can retract to a position where it will not interfere with the feed of sheet bundle S2.

<Stopper>

Stopper 53 is fixed at its part to a shaft that extends perpendicular to the feed direction of sheet bundle S2, so as to function as a sheet positioning element for keeping sheet bundle S2 from falling when stapler 54 has retracted as stated above. Then the stopper pivots and moves to the position indicated by the dashed line in FIG. 2 when guides 55*a,* 55, as will be described, become ready to convey sheet bundle S2. In this way, the stopper is adapted so as not to interfere with stapler 54 and guides 55*a,* 55.

<Guides>

Each guide 55*a,* 55 is fixed at its part to a shaft that extends perpendicular to the feed direction of sheet bundle S2. When stapler 54 has retracted to the position indicated by the dashed line in FIG. 2, guides 55*a,* 55 also move to the positions indicated by the dashed line in FIG. 2. In this way, sheet bundle S2 can be smoothly conveyed toward paper discharge roller 58 after retraction of stopper 53.

In the present embodiment described above, the drive mechanisms for stapler 54, stopper 53 and guides 55*a,* 55 are not mentioned, but needless to say, these movements can be easily achieved by the combination of driving devices such as stepping motors etc., together with the shafts on which these components are fixed.

<Procedures of the Post-Process>

Figure 3:
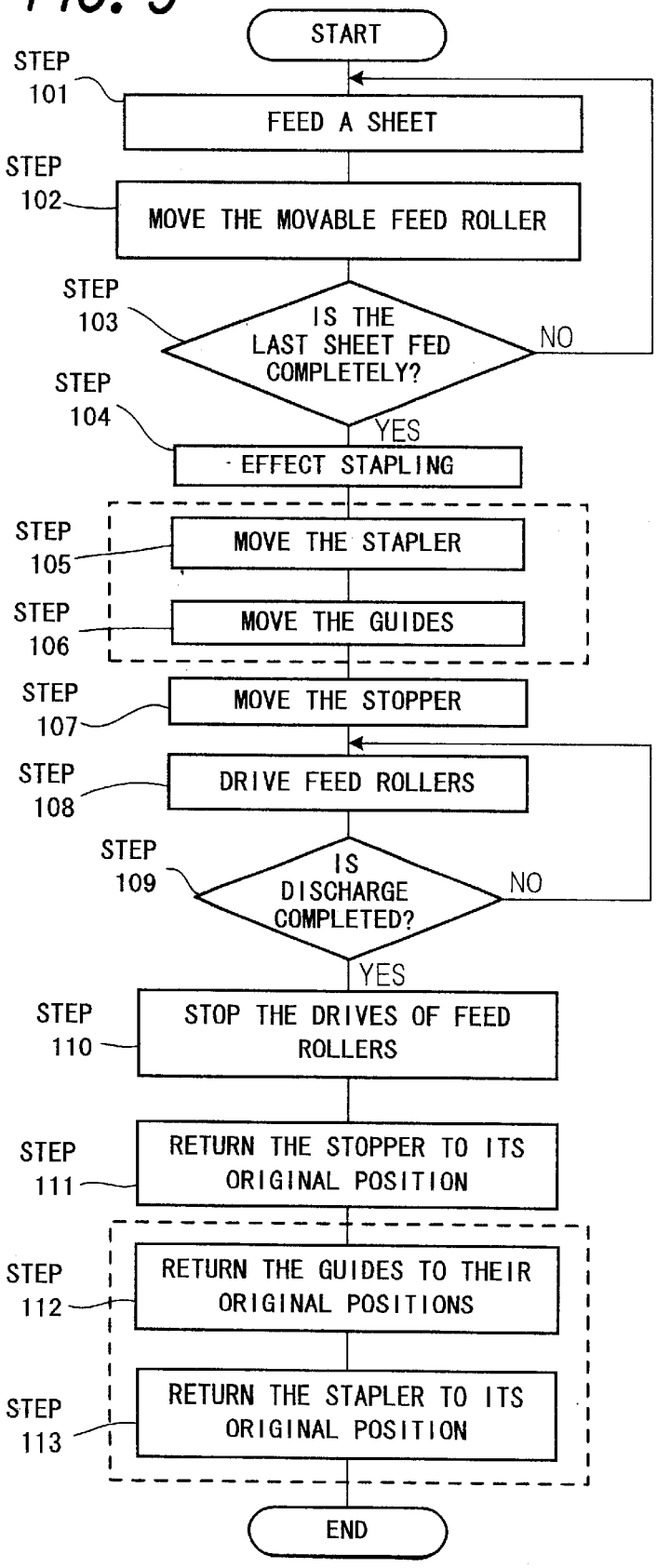
FIG. 3 is a flowchart showing the procedural steps in the sheet post-processing device.

The procedures of the post-process implemented by the sheet post-processing device 5 described above will be explained with reference to the flowchart shown in FIG. 3. 'STEP' in the description hereinbelow indicates each STEP in FIG. 3.

When a print and post-processing request is made by a user, sheet S1 having been printed through printer 2 is conveyed (STEP 101). When the leading end of sheet S1 passing through feed roller 50 reaches movable feed roller 56, the movable feed roller 56 changes its position so that the leading end of sheet S1 reaches stopper 53 by virtue of gravity and the drive force of feed roller 50, whereby sheet S1 is placed on post-processing sheet stacking table 52 when the movable feed roller 56 returns to the original position (STEP 102).

When the last sheet S1 to be post-processed as a whole has been stacked on the post-processing stacking table 52 (STEP 103), stapler 54 is caused to staple the sheet bundle (STEP 104) and then retract to the position indicated by the dashed line in FIG. 2 (STEP 105).

As stapler 54 is completely retracted, guides 55*a,* 55 move to the positions indicated by the dashed line in FIG. 2 (STEP 106). Thereafter, stopper 53 is retracted to the position indicated by the dashed line in FIG. 2 (STEP 107). Then, sheet bundle S2 is conveyed toward discharge roller 58 by virtue of gravity and the driving forces of movable feed roller 56 and feed roller 57 (STEP 108).

Subsequently, solenoid 61 is controlled in accordance with the thickness of sheet bundle S2, thereafter, paper discharge roller 58 is actuated to convey sheet bundle S2 to the paper output tray 51 side. When sheet bundle S2 has been completely discharged(STEP 109), the drives of discharge roller 58, feed roller 57 and the like are stopped (STEP 110).

Then, stopper 53 is returned to its original position to be ready for a next post-processing request (STEP 111). Guides 55 are also returned to their original positions (STEP 112). Finally, stapler 54 is returned to its original position (STEP 113), to thereby complete the sequence of post-processing.

<Stapler Drive Mechanism>

Next, the mechanisms for the aforementioned stapler 54, guides 55*a,* 55 and stopper 53 will be described with reference to FIG. 4, FIG. 5 and FIG. 6, respectively.

Figure 4:
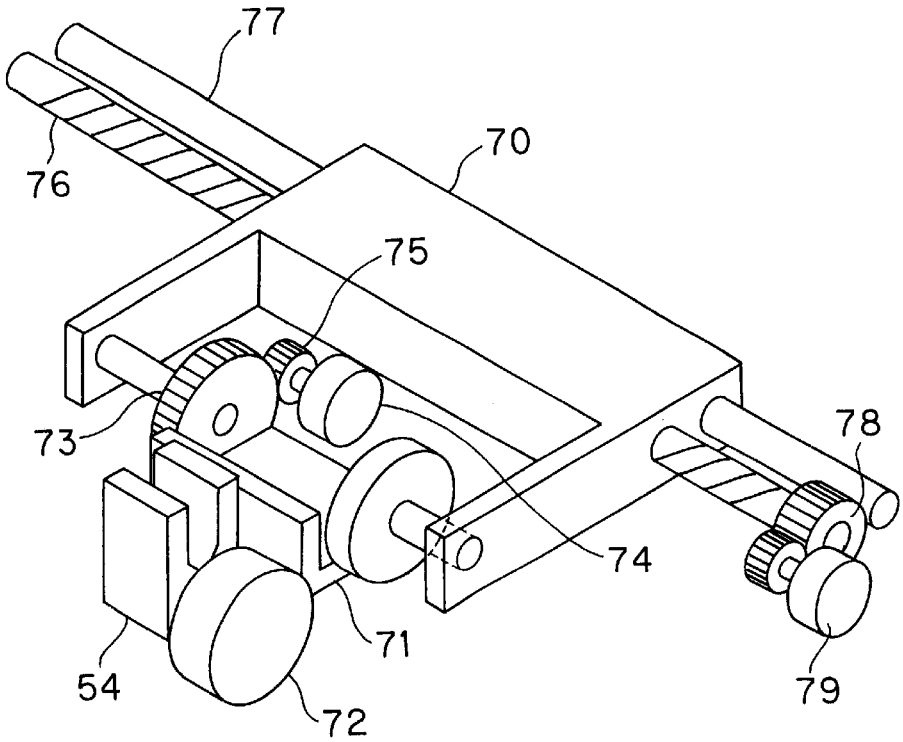
FIG. 4 is a perspective view showing the drive mechanism of a stapler.

FIG. 4 is a perspective view showing a drive mechanism of stapler 54.

Stapler 54 is supported together with a stapler drive motor 72 by a rotary carriage 71 as shown in FIG. 4.

Rotary carriage 71 is axially and rotationally supported with respect to a moving carriage 70. This rotary carriage 71 has a stapler rotating gear 73, which meshes an output gear 75 of a stapler rotating motor 74 fixed to moving carriage 70.

When this stapler rotating motor 74 is driven forward or in reverse, stapler 54 rotates about the rotational axis of rotary carriage 71 so as to pivot between the stapling position and retracted position.

Further, a drive shaft 76 and guide shaft 77 are arranged to pass through moving carriage 70. Guide shaft 77 is the shaft along which moving carriage 70 can be guided in the direction perpendicular to the document in FIG. 2. Drive shaft 76 is a shaft incised with helical male threads on the peripheral surface thereof and is fitted to female threads incised in the mated hole formed through moving carriage 70.

The drive shaft 76 has at its one end a moving gear 78 which meshes an output gear of a stapler moving motor 79. When stapler moving motor 79 rotates forward or in reverse, stapler 54 moves inwards or frontwards in the direction perpendicular to the document in FIG. 2.

<Guide Drive Mechanism>

Figure 5:
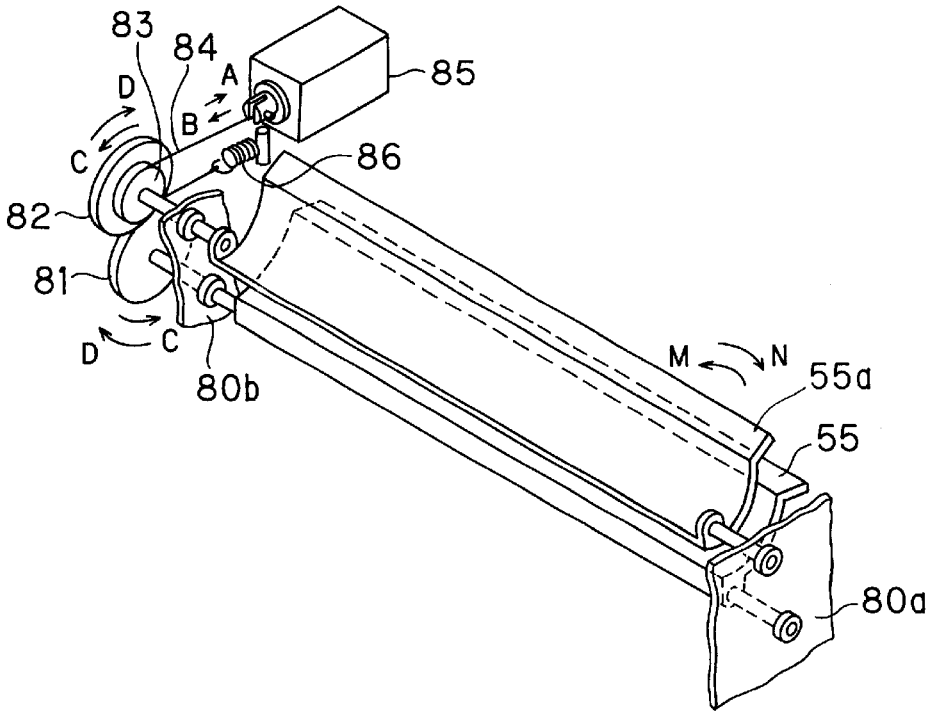
FIG. 5 is a perspective view showing the drive mechanism of guides.

FIG. 5 is a perspective view showing a drive mechanism of guides 55*a,* 55.

Guides 55*a,* 55 are pivotally and axially supported at their front and rear sides by a pair of frames 80 of sheet post-processing device 5, as shown in FIG. 5. A pair of gears 81 and 82 meshing each other are arranged above and below further behind the frame 80 that supports the rear side of guides 55*a,* 55.

A pulley 83 is fixed to the inner side of upper gear 82. The midpoint of a wire 84 is fixed to this pulley 83. The wire 84 is fixed at its one end to a solenoid 85 while the other end of wire 84 is fixed to a spring 86 which is engaged with the rear frame 80*b*.

When solenoid 85 is activated to operate opposing the restoring force of spring 86, wire 84 is pulled in the direction of A so that gear 81 rotates in the direction of C, while gear 82 rotates in the direction of D, whereby guide 55*a* rotates in the direction of N while guide 55 rotates in the direction of M to move to the retracted positions (the positions indicated by the solid line in FIG. 2).

In contrast, when solenoid 85 is deactivated, wire 84 is pulled in the direction of B by the restoring force of spring 86 so that gear 81 rotates in the direction of D while gear 82 rotates in the direction of C, whereby guide 55*a* rotates in the direction of M while guide 55 rotates in the direction of N to move back to the functional positions (the positions indicated by the dashed line in FIG. 2).

<Stopper Drive Mechanism>

Figure 6:
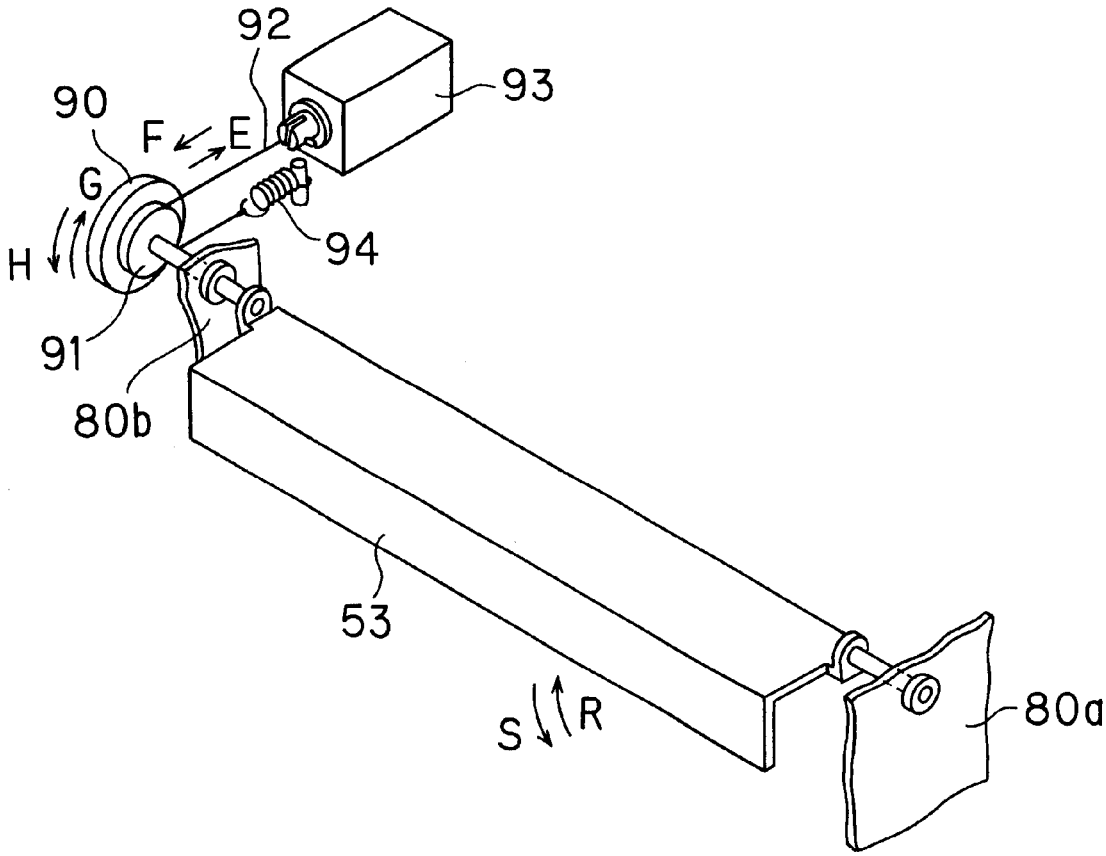
FIG. 6 is a perspective view showing the drive mechanism of a stopper.

FIG. 6 is a perspective view showing a drive mechanism of stopper 53.

Stopper 53 is pivotally and axially supported at its front and rear sides by frames 80 of sheet post-processing device 5, as shown in FIG. 6.

A gear 90 is arranged further behind the frame 80*b* that supports the rear side of stopper 53. A pulley 91 is fixed to the inner side of gear 90. The midpoint of a wire 92 is fixed to this pulley 91. The wire 92 is fixed at its one end to a solenoid 93 while the other end of wire 92 is fixed to a spring 94 which is engaged with the rear frame 80*b*.

When solenoid 93 is activated to operate opposing the restoring force of spring 94, wire 92 is pulled in the direction of E so that gear 90 rotates in the direction of G, whereby stopper 53 rotates in the direction of R to retract to the non-functional positions (the position indicated by the dashed line in FIG. 2).

In contrast, when solenoid 93 is deactivated, wire 92 is pulled in the direction of F by the restoring force of spring 94 so that gear 90 rotates in the direction of H, whereby stopper 53 rotates in the direction of S to move to the functional position (the position indicated by the solid line in FIG. 2).

Since the sheet post-processing device of the present invention is configured as above, it is possible to provide the effects as follows.

The sheet post processing device of the present invention is configured so that part of the space occupied by the conveying device for conveying sheets and part of the space occupied upon the movement of the post-processing device for achieving a post-process over the sheets on the post-processing tray are adapted to share the same space.

Accordingly, if the post-processing means is constructed so as to advance to or retract from the sheets in order to effect a post-process over the sheets or discharge the sheets, it is possible to inhibit increase in size of the arm portion of the post-processing means, increase in size of the drive source of the post-processing means, complexity of the drive mechanism of the post-processing means and the like.

Therefore, it is possible to avoid an increase in size of the machine which is attributed to the necessity of individually securing the space used for the movement of the post-processing means, the space for the conveying means to convey sheets into the post-processing tray and the space for the discharging means to discharge the sheets from the post-processing tray.

Further, since in the sheet post-processing device of the present invention a stopper means is provided on the post-processing table, this prevents the sheets from interfering with other components when the post-processing means moves.

In particular, when the discharged direction of sheets from the post-processing tray is directed downward, it is possible to avoid the deficiency that the sheets drop due to gravity before the conveying means part moves to the space occupied by the post-processing means and impede the movement of the conveying means part.

Finally, in the sheet post-processing device of the present invention, the post-processing means retracts to the side opposite to the post-processing table on which sheets are stacked, or to the space where fewer parts are laid out. Therefore, it is possible to move the conveying means part without any increase in size of the device.

What is claimed is:

1. A sheet post-processing device comprising:

a post-processing table for stacking sheets;

a post-processing means capable of moving between the post-processing position where a post-process is effected on the sheets stacked on the post-processing table and the retracted position where the post-processing means is retracted from the sheets placed on the post-processing table so that the sheets can be discharged;

a conveying means which conveys sheets into, or discharging sheets from, the post-processing table, and has a part which retracts from the space occupied by the post-processing means when the post-processing means is moved to the post-processing position and which also occupies the same space when the post-processing means is moved to the retracted position; and a shifting means for moving the post-processing means and the conveying means part in such a manner that the conveying means part retracts from the space occupied by the post-processing means when the post-processing means is moved to the post-processing position and moves and also moves into the space occupied by the post-processing means when the post-processing means moves back to the retracted position.

2. The sheet post-processing device according to claim 1, further comprising:

a stopper means which moves between a blocking position where discharge of the post-processed sheets on the post-processing table is blocked and the free position where discharge of the post-processed sheets on the post-processing table is permitted, wherein only after the post-processing means has moved to the retracted position and the conveying means part has also moved to the space occupied by the post-processing means, the stopper means moves from the blocking position to the free position.

3. The sheet post-processing device according to claim 1, wherein the post-processing means rotates about an axis extending in a direction perpendicular to the discharged direction of sheets in the post-processing table so as to be retracted to the side opposite to the sheet stacking face of the post-processing table.

* * * * *